US009282414B2

(12) United States Patent
Forman et al.

(10) Patent No.: US 9,282,414 B2
(45) Date of Patent: Mar. 8, 2016

(54) MONITOR AN EVENT THAT PRODUCES A NOISE RECEIVED BY A MICROPHONE

(75) Inventors: George Forman, Port Orchard, WA (US); Bradley Neal Suggs, Sunnyvale, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 79 days.

(21) Appl. No.: 14/357,792

(22) PCT Filed: Jan. 30, 2012

(86) PCT No.: PCT/US2012/023117
§ 371 (c)(1),
(2), (4) Date: May 13, 2014

(87) PCT Pub. No.: WO2013/115768
PCT Pub. Date: Aug. 8, 2013

(65) Prior Publication Data
US 2014/0307880 A1 Oct. 16, 2014

(51) Int. Cl.
*H04R 29/00* (2006.01)
*G10L 21/0208* (2013.01)

(52) U.S. Cl.
CPC ..... *H04R 29/004* (2013.01); *G10L 21/0208* (2013.01); *H04S 2400/15* (2013.01)

(58) Field of Classification Search
None
See application file for complete search history.

(56) References Cited

U.S. PATENT DOCUMENTS

| | | | |
|---|---|---|---|
| 7,613,532 | B2 | 11/2009 | Anderson et al. |
| 7,697,699 | B2 | 4/2010 | Ozawa |
| 2003/0187527 | A1 | 10/2003 | Delchar et al. |
| 2004/0243405 | A1 | 12/2004 | Casparian et al. |
| 2006/0133621 | A1 | 6/2006 | Chen et al. |
| 2011/0125489 | A1 | 5/2011 | Shin |
| 2011/0300806 | A1 | 12/2011 | Lindahl et al. |
| 2015/0091712 | A1* | 4/2015 | Poornachandran et al. ..... 340/407.1 |

FOREIGN PATENT DOCUMENTS

KR 10-2003-011423 A 2/2003

OTHER PUBLICATIONS

Evaluation of IPAQTM Recordings, Aug. 28, 2002, http://www.usenix.org/event/sec02/full_papers/monrose/monrose_html/node10.html.
International Search Report and Written Opinion received in PCT Application No. PCT/US2012/023117, mailed Oct. 24, 2012, 10 pages.

* cited by examiner

*Primary Examiner* — Regina N Holder
(74) *Attorney, Agent, or Firm* — Hewlett-Packard Patent Dept

(57) ABSTRACT

A computing system including a component to perform a function and generates a noise. A microphone to receive an input including the noise. The computing system can monitor a component for an event that produces a noise.

13 Claims, 5 Drawing Sheets

MONITOR AN EVENT THAT PRODUCES A NOISE RECEIVED BY A MICROPHONE

BACKGROUND

Noise suppression for audio devices is important to allow the purest form of the audio to be heard without the addition of unwanted noise, For example, some forms of noise reduction reduce the gain on specific frequencies without regard to whether there is actually noise in the audio. This can result in less than optimum audio reproduction since some of the actual audio is lost by trying to reduce the noise in the audio.

BRIEF DESCRIPTION OF THE DRAWINGS

Some embodiments of the invention are described with respect to the following figures.

DETAILED DESCRIPTION

A system can determine when a noise would have been recorded by a microphone and only look at that time to determine if the gain for a frequency or band of frequencies should be reduced or some other way to reduce the noise on the recording. Knowing the time of the noise can increase the audio quality by not blindly reducing all audio at a particular frequency. Noise can be unwanted sound captured by a microphone.

Some systems have attempted to remove the noise by using multiple microphones where a process was applied to the recorded data comparing them and removing noise from the recording. However, if there is not a combination of two forms of the audio, the process may take out audio that was intended. If a system knows when an event occurs, the type of event, and the sound of an event, the noise generated when the event occurs can be reduced without removing other intended audio from the input. An event can be an electrical signal that relates to a function of a component and not the resulting noise from the component.

For example, if a computing system is recording an audio input with a microphone and a hard disk drive is accessed, the system knows that the hard disk drive has been accessed and that event is known to generate noise. The noise can be the arm moving to seek the correct disk track. The noise created by the hard disk drive can be known by the computer by storing a sound profile. The system can monitor the system for an event which results in noise and use the sound profile of the event to remove the noise at the point in the input recording that the event was known to have occurred to create an input recording that has reduced noise but also retains substantially all of the intended audio.

In one embodiment a computing system can include a connection to a component to perform a function and generates a noise. A microphone can receive an input including the noise. A controller in the system can monitor the component for an event related to the function that produces the noise and track the time of the event in the input.

In another embodiment, a method can remove noise from a sound input by monitoring a component for an event that produces a noise. A microphone can receive an input including the noise. A stored sound profile related to the event can be retrieved from memory. The noise can be reduced from the input using the stored sound profile.

Figure 1:
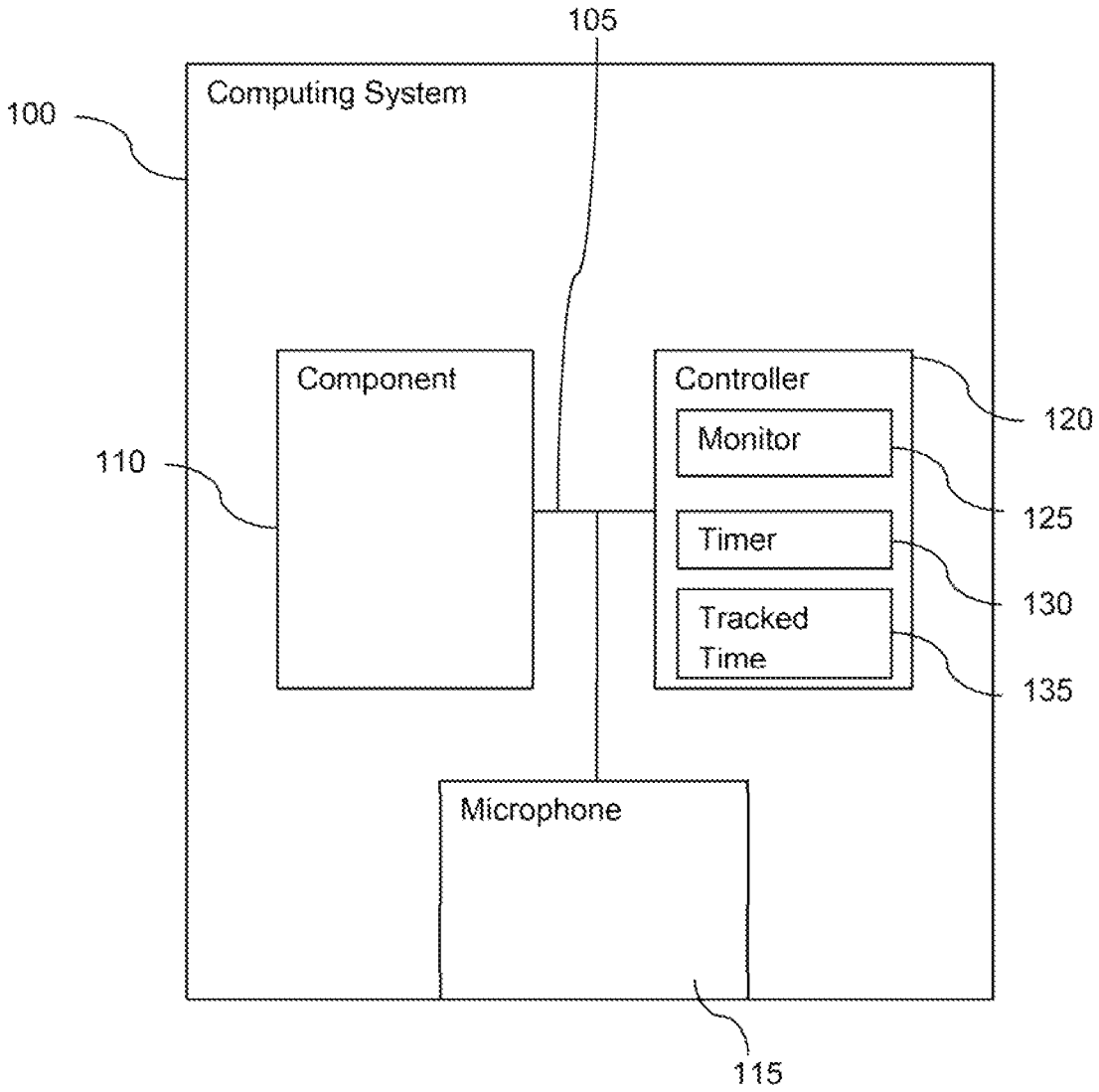
FIG. 1 is a block diagram of a computing system for recording an input from a microphone according to an example implementation.

FIG. 1 is a block diagram of a computing system for recording an input from a microphone according to an example implementation. A computing system 100 can include a connection 105 to a component 110 to perform a function and generates a noise. The component 110 may be, for example, a hard disk drive head, a key on a keyboard, a button on a mouse, a CD drawer motor, or another component that generates noise as a byproduct or performing an intended function. The component 110 can be part of the computing system 100 or may be external to the computing system 100 such as an external hard disk drive, or an external keyboard or in one embodiment the computing system may be connected to an automobile that can communicate with the computing system and notify the computing system of events related to the automobile.

The connection 105 may be wired such as by electrically conductive wires optical wires, or another technology. The connection 105 may be wireless such as Bluetooth, wireless fidelity (wifi) or another wireless technology.

A microphone 115 can receive an input including the noise. The input is the audio that is intended to be received by the computing system 100 though the microphone and the noise is the unintentional sounds generated by components of the system captured by the microphone 115 while receiving the intended audio. A controller 120 in the computing system 100 can monitor the component for an event related to the function that produces the noise. The controller may be a general purpose processor, an application specific processor (ASIC) or another type of controller. A monitor 125 can receive information from the component or may snoop a bus such as a Peripheral Component Interconnect express (PCIe) bus for instructions to components that result in the component performing a noise generating event. The computing system 100 can include a timer 130 to track time. The controller 120 can track the time of the event in the input. The tracked time may be relative time to the input recording or an absolute time. For example, the relative tracked time may be 2 seconds from the beginning of the input. If the tracked time is an absolute time it may be Jan. 1, 2012 at 2:00:02 GMT, the absolute time of the input would have to be tracked as vs well such beginning at Jan. 1, 2012 at 2:00:00 GMT.

The tracked time 135 may be adjusted based on variables; for example, if the monitor intercepts an instruction from a bus that has not been received by the component, the controller may apply an offset to the tracked time to account for the time that it takes for controller receiving the instruction and performing the function that results in the noise. In the case where the monitor receives from a component information of an event related to a function of the component an offset may be applied to account for the function having already be performed. The offset on the tracked time may be for example, a tenth of a millisecond plus or minus.

Figure 2:
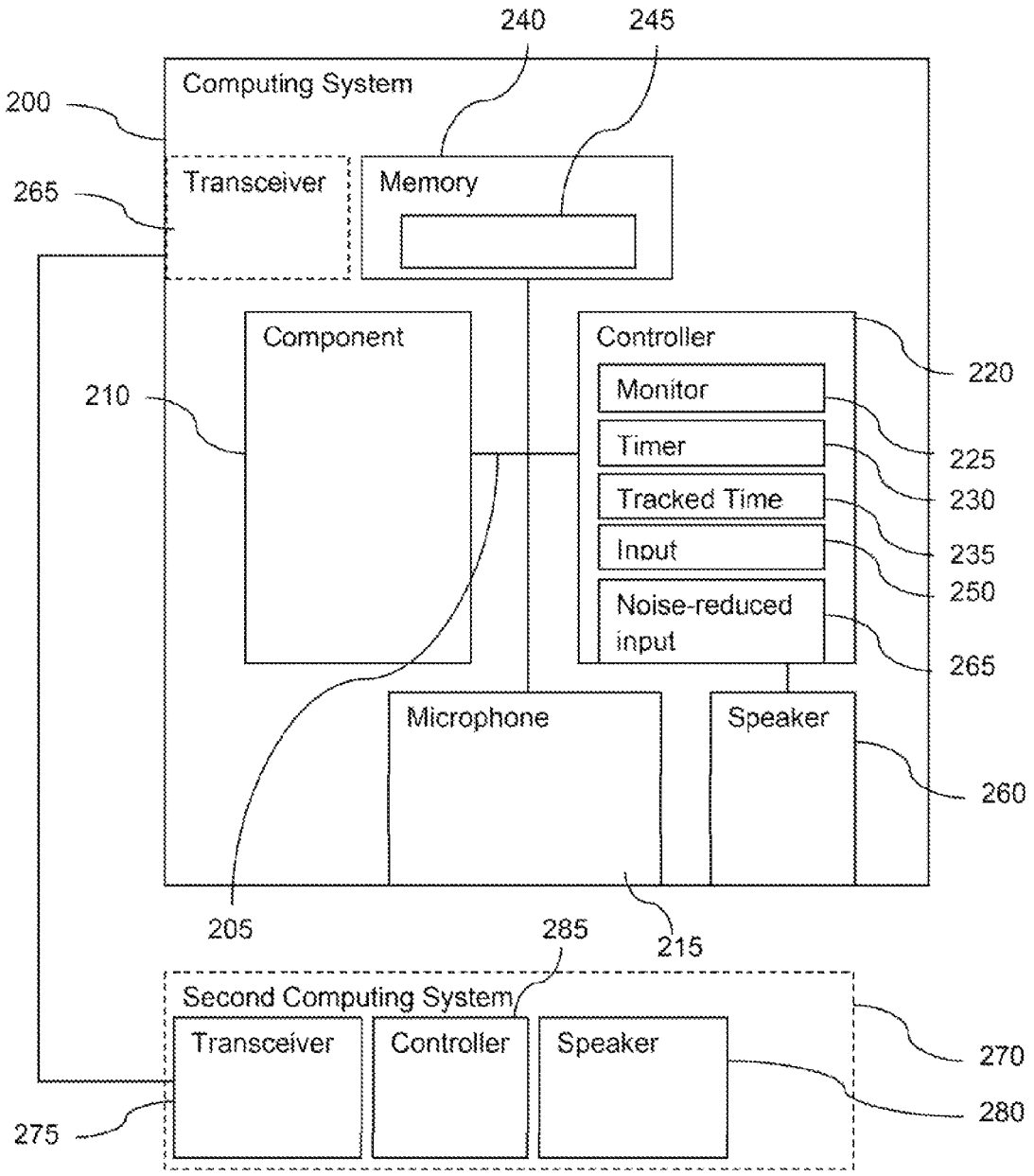
FIG. 2 is a block diagram of a computing system for recording an input from a microphone according to an example implementation.

FIG. 2 is a block diagram of a computing system 200 for recording an input from a microphone according to an example implementation. The computing system 200 can include a connection 205 to a component 210 to perform a function and generates a noise. A microphone 215 can receive an input including the noise. A controller 220 in the computing system 200 can monitor the component 210 for an event related to the function that produces the noise and track the time of the event in the input. The controller can include a monitor 225, a timer 230, the tracked time 235.

A memory 240 stores data 245. The memory may be volatile such as Random access memory (RAM) or non-volatile memory such as a hard disk drive, flash memory. While depicted as two components the component 210 may be the memory 240, for example, if the component 240 is a hard disk drive, it may be both the memory 240 and the component 210. The data 245 on the memory 240 may be, for example, the input, a sound profile of the noise related to an event, the tracked time of an event, the type of event.

The controller can track the type of event. For example, the type of event may be a hard disk access, the ejection of an optical disk, the plugging in of a peripheral to a port such as a USB port, the activation of a key on the keyboard, the activation of a button on a mouse, or another noise producing event that can be received by a microphone. The type of event may be related to a sound profile. The sound profile for an event may, for example, reduce the gain of the microphone for the input, apply a graphic equalizer to reduce the gain for a particular frequency band, include a time length for the noise related to the event, include a recording including a time dimension for noises that change over time such as a disk drive for fan spinning up, include an inverse of the noise used to subtracted out the noise from the input, or differences in multichannel recordings such as when a keys on a keyboard are closer to or further from the multiple microphones. The differences in multichannel recordings may account, for example, for the "a" being on one end of a keyboard and the "p" being on the opposite end of a keyboard. The sound profile may be generated by recording sounds in a controlled environment. To create a sound profile the computing system may cause a component to complete a function that generates an event while suppressing other components from performing a noise producing function and record the sound through the microphone in a controlled environment that is quiet, for example. The data can be generated about the noise such as the length of the noise, any changes in the noise over time, the frequency of the noise, or differences between multiple channels or different sound profiles each of the multiple channels, or the inverse of the noise that can be used to subtract the noise from the input. In some cases the sound profiles may be loaded on a system by a manufacturer but in other cases the sound profiles may be generated by an end user. Allowing the sound profiles to be generated by the end user can allow noise generated by a component connected to the computing system at a later time or components that were changed or sound different after age. The computing system may suggest that new sound profiles be recorded as the system ages. For example, if it is known that the hard disk drive likely will sound different after a year of use, the computing system can suggest a new sound profile for the hard disk drive be generated.

The controller 220 can use the tracked time 235 to locate the event in the input 250 and with the type of event can locate a corresponding sound profile for the event to remove the noise from the input 250 generating a noise-reduced input 255. The noise reduced input may be played back through the speaker 260 with a substantially less level of noise that was generated by the component 210.

The computing system can include transceiver 265 to transmit the input and the tracked time to a second computing system 270 for output by the second computing system 270, for example, in a teleconference system. The second computing system 270 outputs one of the input and a noise-reduced input generated from the tracked time. The second computing system 270 may include a second transceiver 275 to receive data from the computing system. The second computing system may also include a speaker 280 to output the recording input. The computing system and the second computing system may be set up to teleconference. The second computing system 270 may include a controller 285 to output one of the input and the noise-reduced input. The controller 285 may receive the noise-reduced input 265 created by the controller 220 or may receive the input and the time and type of events tracked by the controller 220. By receiving the input, tracked time of the event and the type of event can allow the second computing system to determine whether the output is of the input or the noise-reduced input. The sound profile may be sent to the second computing system 270 from the computing system 200, and may only be sent once for each type of event.

The memory 240 can store the noise-reduced input and the time tracked, wherein the input can be generated from the noise-reduced input, the time tracked and the sound profile. To reduce the amount of memory the input and the noise-reduced input may not both be stored on the memory 240. If the noise-reduced input is stored on the memory 240 the input which includes the noise may be able to be recreated from the noise-reduced input. the tracked time of an event, the type of event and the sound profile by reversing the effects of the sound profile.

Figure 3:
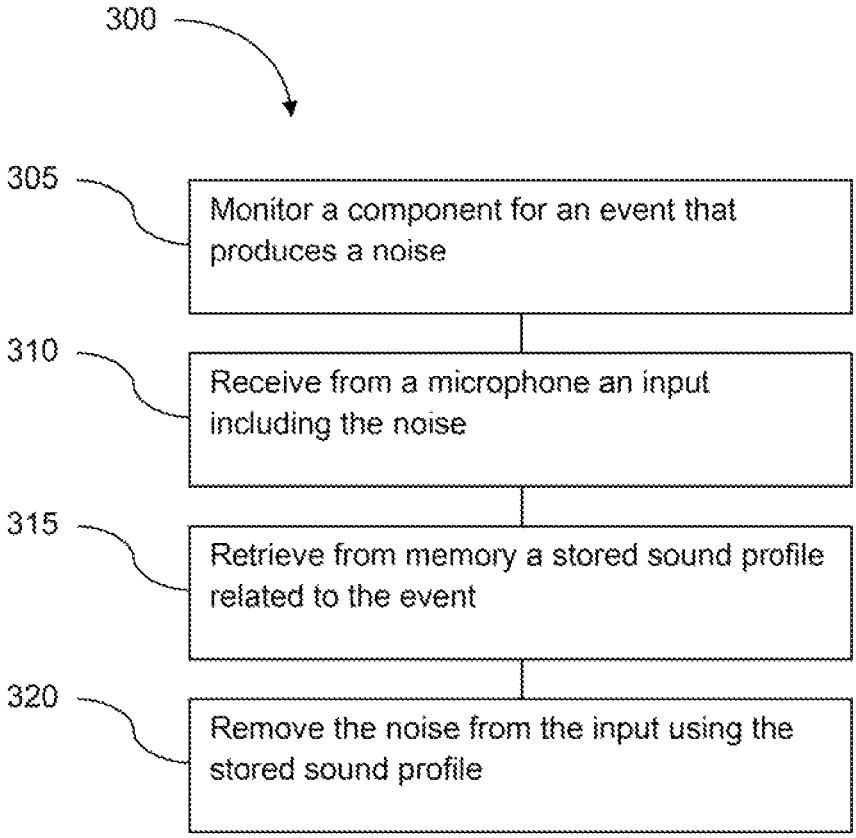
FIG. 3 is a flow diagram of a method of recording an input from a microphone with a computing system according to an example implementation.

FIG. 3 is a flow diagram of a method of recording an input from a microphone with a computing system according to an example implementation. The method 300 may be performed, for example, by the computing system 100 or 200 or another computing system. The method 300 can remove noise from a sound input by monitoring a component for an event that produces a noise at 305. The component may be, for example, component 110. The monitoring may be done, for example, by a controller 120. A microphone can receive an input including the noise at 310. A stored sound profile related to the event can be retrieved from memory at 315. The sound profile may be data 245 stored in the memory 240. The noise can be reduced from the input using the stored sound profile at 320. The reduction of the noise from the stored sound profile may be done with a controller.

Figure 4:
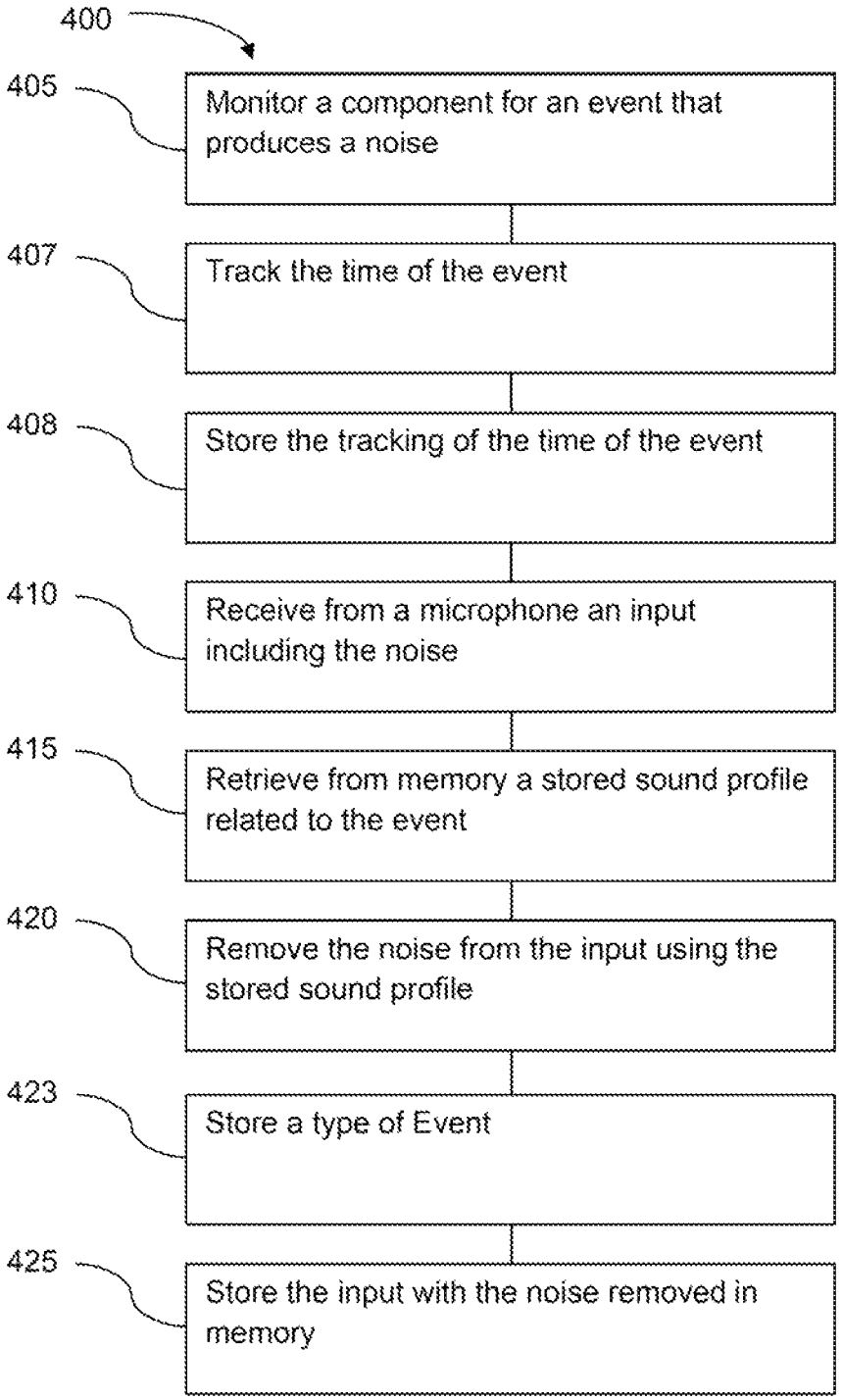
FIG. 4 is a flow diagram of a method of recording an input from a microphone with a computing system according to an example implementation.

FIG. 4 is a flow diagram of a method of recording an input from a microphone with a computing system according to an example implementation. The method 400 may be performed, for example, by the computing system 100 or 200 or another computing system. The method 400 can remove noise from a sound input by monitoring a component for an event that produces a noise at 405. The component may be, for example, component 110. The monitoring may be done, for example, by a controller 120. The time of the event can be tracked at 407. The tracking of the time of the event may be done using a timer. The tracking of the time of the event can be stored at 408; for example, the tracked time may be stored in a memory. The A microphone can receive an input including the noise at 410. A stored sound profile related to the event can be retrieved from memory at 415. The sound profile may be data 245 stored in the memory 240. The noise can be reduced from the input using the stored sound profile at 420. The reduction of the noise from the stored sound profile may be done with a controller. A type of the event can be stored in memory at 423. The input with the noise reduced can be stored in memory at 425. The blocks of the method 400 may be rearranged from the order described and show in the figure.

Figure 5:
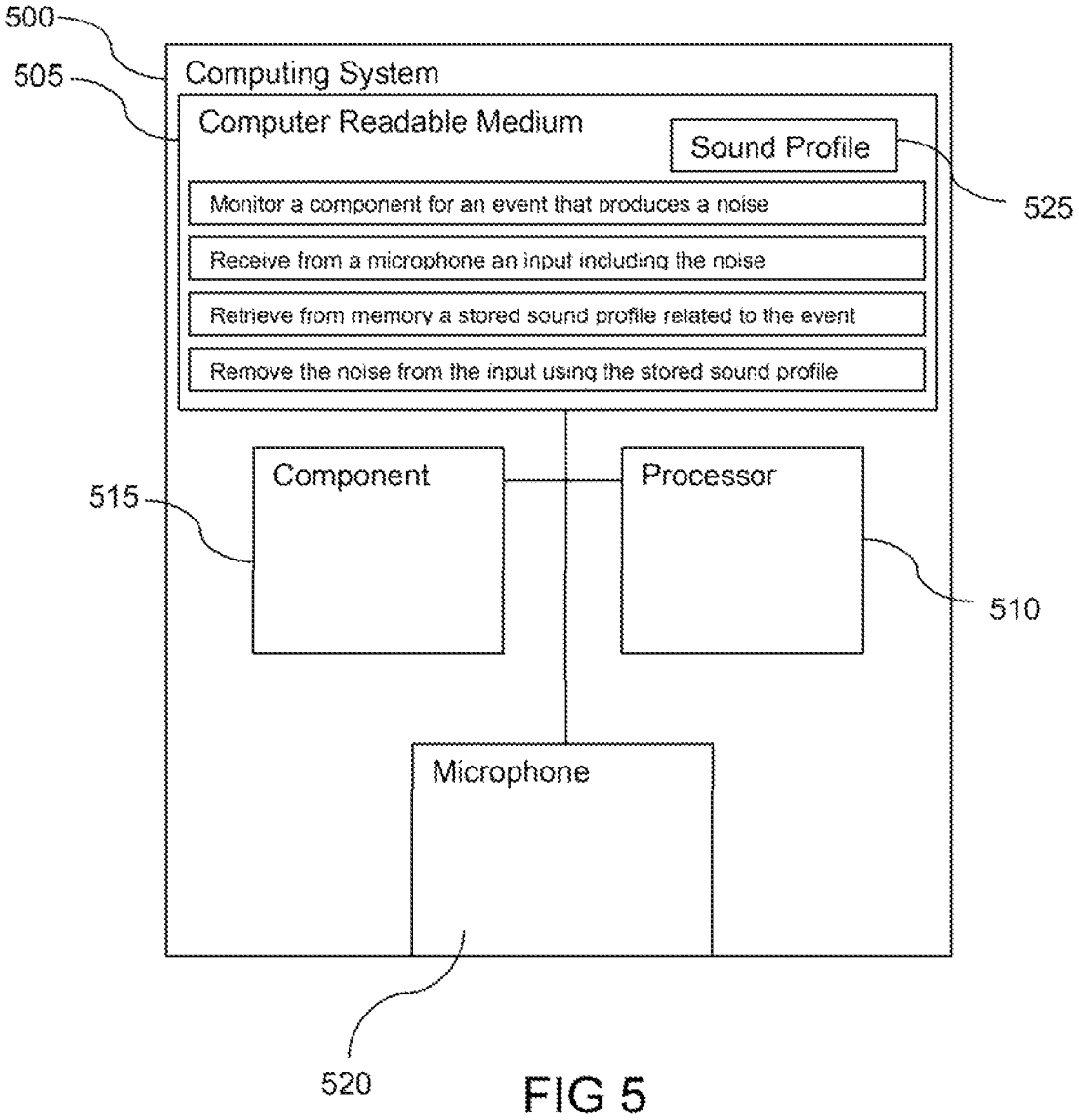
FIG. 5 is a computing system including a computer readable medium according to an example implementation.

FIG. 5 is a computing system including a computer readable medium according to an example implementation. A non-transitory computer readable medium 505 can include code that if executed by a processor 510 causes a computing system 500 monitor a component 515 for an event that produces a noise. The code can cause the processor to receive from a microphone 520 an input including the noise. The code can cause the processor to retrieve from computer readable medium a stored sound profile 525 related to the event. The processor can reduce the noise from the input using the stored sound profile. The processor may track the time of the event and store the tracking of the time of the event in the non transitory computing readable medium 505.

The techniques described above may be embodied in a non-transitory computer-readable medium for configuring a computing system to execute the method. The computer readable media may include, for example and without limitation, any number of the following: magnetic storage media including disk and tape storage media; optical storage media such as compact disk media (e.g., CD-ROM, CD-R, etc.) and digital video disk storage media; holographic memory; nonvolatile memory storage media including semiconductor-based memory units such as FLASH memory, EEPROM, EPROM, ROM; ferromagnetic digital memories; volatile storage media including registers, buffers or caches, main memory, RAM, etc.; and the Internet, just to name a few. Other new and various types of computer-readable media may be used to store the software modules discussed herein. Computing systems may be found in many forms including but not limited to mainframes, minicomputers, servers, workstations, personal computers, notepads, personal digital assistants, various wireless devices and embedded systems, just to name a few.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A computing system comprising:

a connection to a component to perform a function and generates a noise;

a microphone to receive an input including the noise; and a controller to monitor the component for an event related to the function that produces the noise and track a time length of the event in the input.

2. The system of claim 1, further comprising a memory to store the input.

3. The system of claim 1, further comprising a memory to store a sound profile of the noise.

4. The system of claim 3, wherein the controller tracks the type of event.

5. The system of claim 4, wherein the controller uses the tracked time length to locate the event in the input and remove the noise from the stored input generating a noise-reduced input.

6. The system of claim 4, further comprising a transceiver to transmit the input and the tracked time length to a second computing system for output by the second computing system, wherein the second computing system outputs one of the input and a noise-reduced input generated from the tracked time length.

7. The system of claim 4, further comprising a memory to store the noise-reduced input and the time tracked, wherein the input can be generated from the noise-reduced input, the time tracked and the sound profile.

8. A method of removing noise from a sound input of a computing system comprising:

monitoring a component for an event that produces a noise;

receiving from a microphone an input including the noise;

tracking a time length associated with the input;

retrieving from memory a stored sound profile related to the event; and reducing the noise from the input using the stored sound profile.

9. The method of claim 8, further comprising storing the tracking of the time length of the event.

10. The method of claim 8, further comprising storing the input with the noise removed in memory.

11. The method of claim 8, further comprising storing a type of the event.

12. A non-transitory computer readable medium comprising code that if executed by a processor causes a computing device to:

monitor a component for an event that produces a noise;

receive from a microphone an input including the noise;

track a time length associated with the event;

retrieve from computer readable medium a stored sound profile related to the event; and reduce the noise from the input using the stored sound profile.

13. The computer readable medium of claim 12 further comprising code that if executed causes a computing device to store the tracking of the time length of the event.

* * * * *